US009629469B1

(12) United States Patent
Watkins

(10) Patent No.: US 9,629,469 B1
(45) Date of Patent: Apr. 25, 2017

(54) LUMBAR SUPPORT SYSTEM

(71) Applicant: Mary Watkins, Jacksonville, FL (US)

(72) Inventor: Mary Watkins, Jacksonville, FL (US)

( * ) Notice: Subject to any disclaimer, the term of this patent is extended or adjusted under 35 U.S.C. 154(b) by 0 days.

(21) Appl. No.: 15/152,552

(22) Filed: May 12, 2016

(51) Int. Cl.
*A47C 7/46* (2006.01)
*F04B 35/04* (2006.01)

(52) U.S. Cl.
CPC ..... *A47C 7/467* (2013.01); *F04B 35/04* (2013.01)

(58) Field of Classification Search
CPC ..... A47C 7/467; F04B 35/04
USPC ..... 297/284.6
See application file for complete search history.

(56) References Cited

U.S. PATENT DOCUMENTS 489,187 A 1/1893 Moore
3,446,204 A * 5/1969 Murphy ..... 601/57
3,652,126 A * 3/1972 Folling ..... A47C 7/467 297/284.6
4,619,481 A * 10/1986 Grudzinskas ..... A47C 7/467 137/883
4,722,550 A * 2/1988 Imaoka ..... A47C 7/022 180/268
5,020,517 A * 6/1991 Foster, Jr. ..... A61H 23/0263 297/284.1
D418,986 S 1/2000 Natuzzi et al.
6,814,709 B2 * 11/2004 Schwartz ..... A47C 7/725 5/633
7,350,864 B1 * 4/2008 Brewster ..... A47C 3/02 297/260.2
D571,561 S 6/2008 Natuzzi
7,806,477 B2 10/2010 LaPointe et al.
7,841,667 B2 11/2010 Mossbeck
9,468,301 B2 * 10/2016 Rivera ..... A47C 7/467
2006/0097556 A1 5/2006 Jang
2009/0079245 A1 3/2009 Marcantoni
2009/0184553 A1 7/2009 Dauphin
2014/0159443 A1 6/2014 Quint

* cited by examiner

*Primary Examiner* — Milton Nelson, Jr.

(57) ABSTRACT

A lumbar support system includes a chair that may be sat in. A balloon is positioned within the chair. The chair has a backrest and the balloon is positioned in the backrest. Thus, the balloon is aligned with lumbar vertebra when the chair is sat in. An inflation unit is coupled to the chair and the inflation unit is in fluid communication with the balloon. The inflation unit selectively inflates the balloon. Thus, the balloon may provide a selected degree of lumbar support.

5 Claims, 4 Drawing Sheets

LUMBAR SUPPORT SYSTEM

BACKGROUND OF THE DISCLOSURE

Field of the Disclosure

The disclosure relates to support devices and more particularly pertains to a new support device for providing lumbar support in a chair.

SUMMARY OF THE DISCLOSURE

An embodiment of the disclosure meets the needs presented above by generally comprising a chair that may be sat in. A balloon is positioned within the chair. The chair has a backrest and the balloon is positioned in the backrest. Thus, the balloon is aligned with lumbar vertebra when the chair is sat in. An inflation unit is coupled to the chair and the inflation unit is in fluid communication with the balloon. The inflation unit selectively inflates the balloon. Thus, the balloon may provide a selected degree of lumbar support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
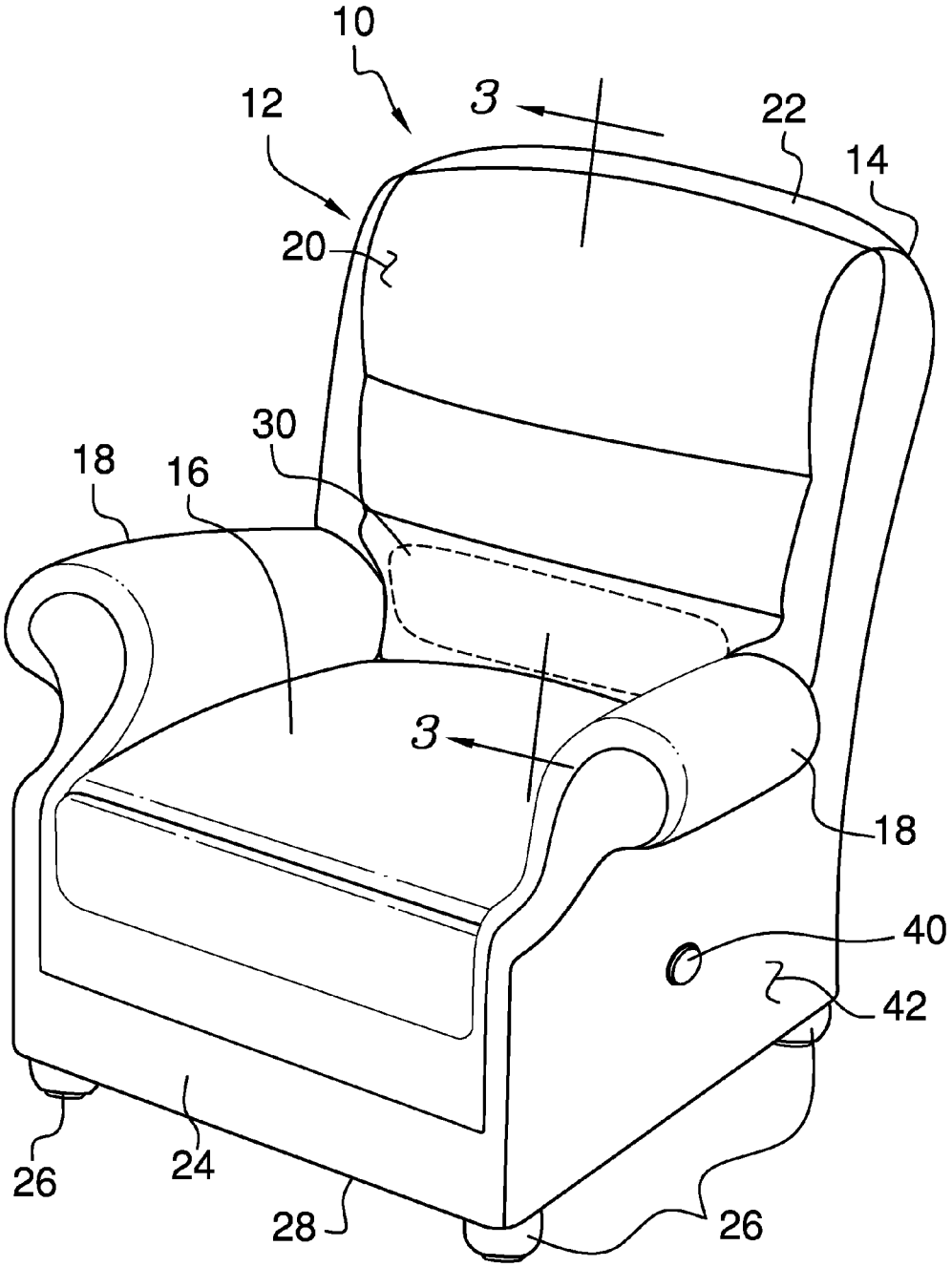
FIG. 1 is a front perspective view of a lumbar support system according to an embodiment of the disclosure.
Figure 2:
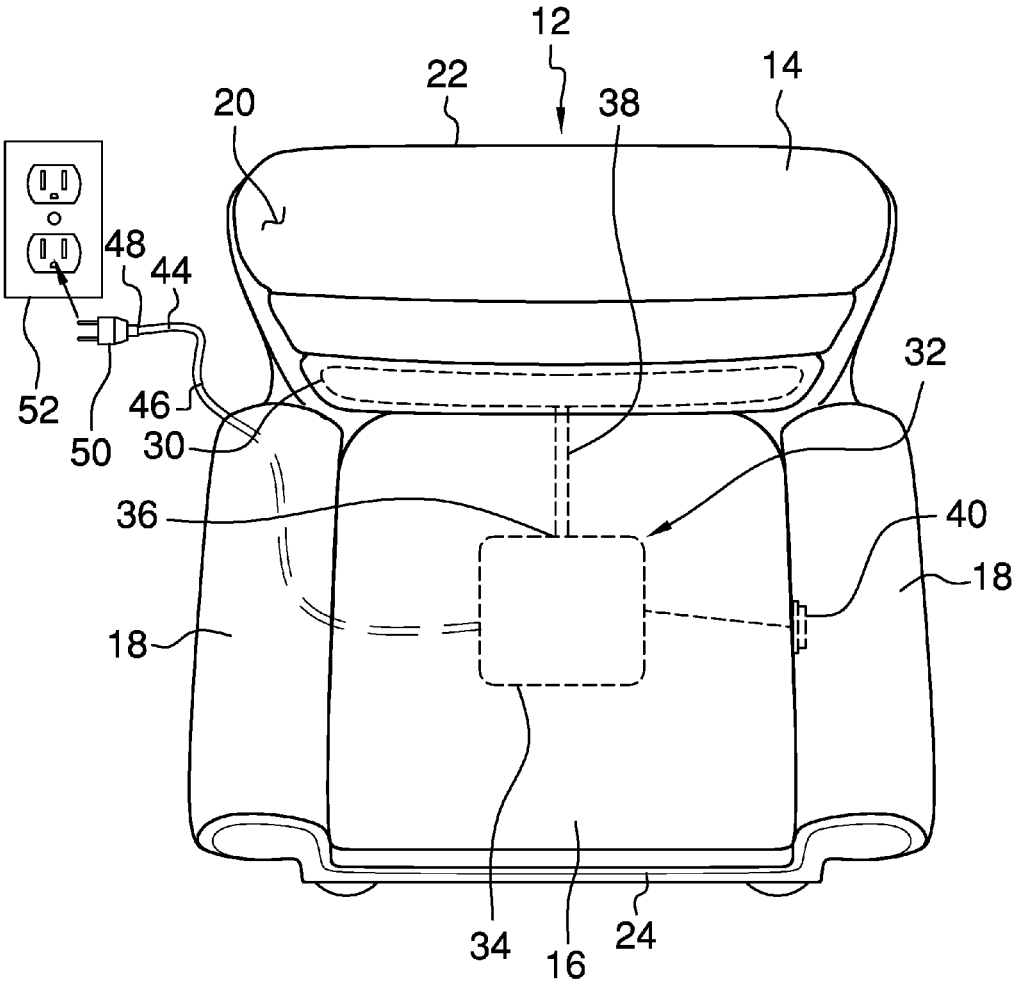
FIG. 2 is a top phantom view of an embodiment of the disclosure.
Figure 3:
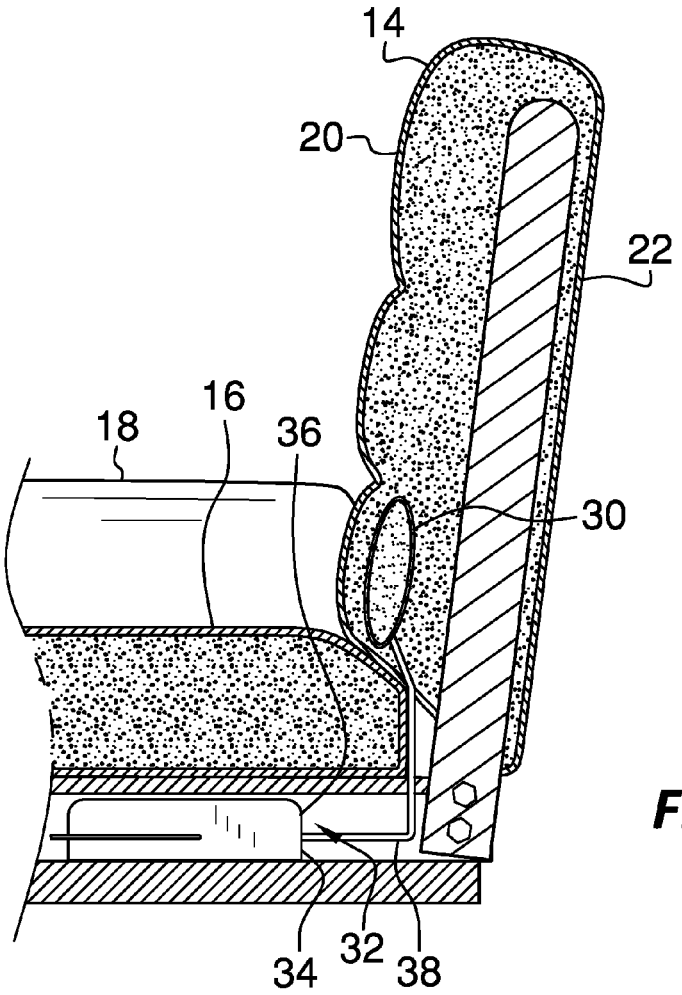
FIG. 3 is a cross sectional view taken along line 3-3 of FIG. 1 of an embodiment of the disclosure.
Figure 4:
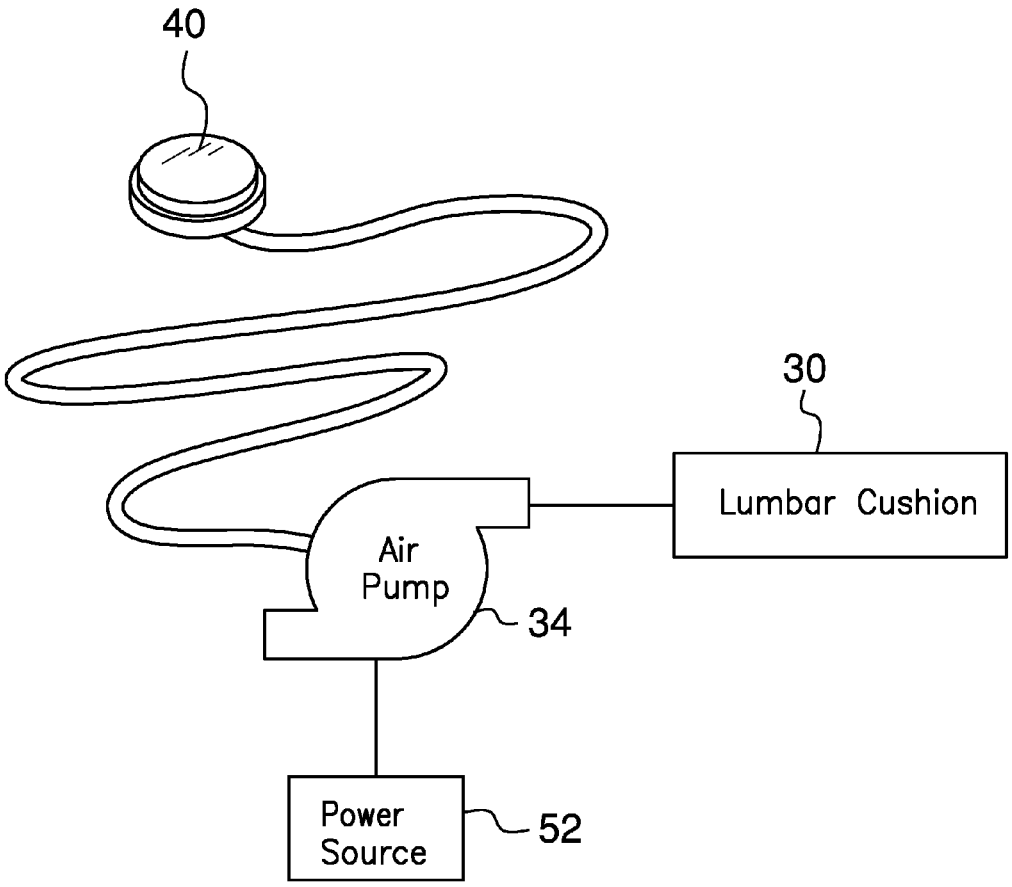
FIG. 4 is a schematic view of an embodiment of the disclosure.

With reference now to the drawings, and in particular to FIGS. 1 through 4 thereof, a new support device embodying the principles and concepts of an embodiment of the disclosure and generally designated by the reference numeral 10 will be described.

As best illustrated in FIGS. 1 through 4, the lumbar support system 10 generally comprises a chair 12 that may be sat in. The chair 12 has a backrest 14, a seat 16 and a pair of armrests 18. The backrest 14 has a first surface 20 and a second surface 22. The chair 12 may comprise an easy chair or the like. Additionally, each of the seat 16 and the backrest 14 may be comprised of a resiliently compressible material such as foam rubber or the like.

The backrest 14 may have a height ranging between fifty five cm and seventy cm. Thus, the backrest 14 may support a full height of a user's back and the user's head. Each of the armrests 18 may have a length ranging between eighty cm and ninety five cm. Thus, each of the armrests 18 may support and entire length of the user's arms.

The seat 16 and the backrest 14 may be upholstered in leather and the leather may have a cream color. Each of the armrests 18 may be upholstered in a textile such as cotton or the like. Wooden accents may be provided, and the wooden accents may be positioned on a front side 24 of the chair 12. A plurality of feet 26 may be provided, and each of the feet 26 may be coupled to a bottom 28 of the seat 16. Each of the feet 26 may have a length ranging between seven cm and thirteen cm.

A balloon 30 is coupled to the chair 12 and the balloon 30 is positioned within the backrest 14. The balloon 30 is positioned between the first surface 20 and the second surface 22 of the backrest 14. The balloon 30 is substantially aligned with an intersection of the backrest 14 and the seat 16. Thus, the balloon 30 is aligned with lumbar vertebra when the chair 12 is sat in. Moreover, the balloon 30 extends substantially across a width of the backrest 14.

An inflation unit 32 is coupled to the chair 12. The inflation unit 32 is in fluid communication with the balloon 30. The inflation unit 32 selectively inflates the balloon 30. Thus, the balloon 30 may provide a selected degree of lumbar support.

The inflation unit 32 comprises a pump 34 that is positioned within the chair 12 and the pump 34 has an output 36. The pump 34 may comprise an electrical air pump or the like. A hose 38 is fluidly coupled between the output 36 and the balloon 30. Thus, the pump 34 selectively inflates the balloon 30.

A button 40 is coupled to the chair 12 and the button 40 may be manipulated. Each of the armrests 18 has an outwardly facing surface 42. The button 40 may be positioned on the outwardly facing surface 42 of an associated one of the armrests 18. The button 40 is electrically coupled to the pump 34 such that the button 40 selectively turns the pump 34 on.

A power supply 44 is electrically coupled to the pump 34. The power supply 44 comprises a power cord 46 extending outwardly from the chair 12. The power cord 46 has a distal end 48 with respect to the chair 12. A plug 50 is electrically coupled to the distal end 48. The plug 50 may be electrically coupled to a power source 52. The power source 52 may be an electrical outlet or the like.

In use, the chair 12 is sat in and the button 40 is depressed. The pump 34 is turned on and the pump 34 inflates the balloon 30. The button 40 is continually depressed until the balloon 30 is inflated to a desired amount. The balloon 30 urges the first surface 20 of the backrest 14 forwardly when the balloon 30 is inflated. Thus, the balloon 30 facilitates lumbar support when the chair 12 is sat in.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lumbar support system comprising:

a chair being configured to be sat in, said chair having a backrest, a seat, and a pair of armrests;

a balloon being positioned within said chair, said balloon being positioned in said backrest wherein said balloon is configured to be aligned with lumbar vertebra when said chair is sat in;

an inflation unit being coupled to said chair, said inflation unit being in fluid communication with said balloon, said inflation unit selectively inflating said balloon wherein said balloon is configured to provide a selected degree of lumbar support, said inflation unit comprising a pump being positioned within said chair, said pump having an output fluidly coupled to said balloon wherein activation of said pump inflates said balloon; and a button being coupled to said chair wherein said button is configured to be manipulated, said button being electrically coupled to said pump such that said button selectively turns said pump on, said button being an only button positioned on an outwardly facing surface of one of said armrests wherein said button is configured to inhibit inadvertent pressing of said button while said button is accessible by a person downwardly extending an arm outside of said one of said armrests while seated on said seat.

2. The system according to claim 1, wherein:

said backrest has a first surface and a second surface; and said balloon is positioned between said first surface and said second surface, said balloon being substantially aligned with an intersection of said backrest and said seat.

3. The system according to claim 1, further comprising a power supply being electrically coupled to said pump, said power supply comprising a power cord extending outwardly from said chair, said power cord having a distal end with respect to said chair, said power cord having a plug being electrically coupled to said distal end, said plug being configured to be electrically coupled to a power source.

4. The system according to claim 1, further comprising a hose being fluidly coupled between said output and said balloon such that said pump selectively inflates said balloon.

5. A lumbar support system comprising:

a chair being configured to be sat in, said chair having a backrest, a pair of armrests, and a seat, said backrest having a first surface and a second surface; and a balloon being positioned within said chair, said balloon being positioned in said backrest wherein said balloon is configured to be aligned with lumbar vertebra when said chair is sat in, said balloon being positioned between said first surface and said second surface, said balloon being substantially aligned with an intersection of said backrest and said seat; and an inflation unit being coupled to said chair, said inflation unit being in fluid communication with said balloon, said inflation unit selectively inflating said balloon wherein said balloon is configured to provide a selected degree of lumbar support, said inflation unit comprising:

a pump being positioned within said chair, said pump having an output, a hose being fluidly coupled between said output and said balloon such that said pump selectively inflates said balloon, a button being coupled to said chair wherein said button is configured to be manipulated, said button being electrically coupled to said pump such that said button selectively turns said pump on, said button being an only button positioned on an outwardly facing surface of one of said armrests wherein said button is configured to inhibit inadvertent pressing of said button while said button is accessible by a person downwardly extending an arm outside of said one of said armrests while seated on said seat, and a power supply being electrically coupled to said pump, said power supply comprising a power cord extending outwardly from said chair, said power cord having a distal end with respect to said chair, said power cord having a plug being electrically coupled to said distal end, said plug being configured to be electrically coupled to a power source.

* * * * *